US006899040B2

(12) United States Patent
Johnson

(10) Patent No.: US 6,899,040 B2
(45) Date of Patent: May 31, 2005

(54) FURNITURE HAVING INTERCHANGEABLE PARTS AND METHOD THEREOF

(76) Inventor: Edward H. Johnson, 9761 E. Pinnacle Vista Dr., Scottsdale, AZ (US) 85255

( * ) Notice: Subject to any disclaimer, the term of this patent is extended or adjusted under 35 U.S.C. 154(b) by 303 days.

(21) Appl. No.: 10/202,972

(22) Filed: Jul. 24, 2002

(65) Prior Publication Data

US 2004/0016372 A1 Jan. 29, 2004

(51) Int. Cl.[7] ..... A47B 13/00
(52) U.S. Cl. ..... 108/153.1; 108/180
(58) Field of Search ..... 108/153.1, 156, 108/157.1, 157.16, 180, 181, 186, 190, 27, 11

(56) References Cited

U.S. PATENT DOCUMENTS 827,834 A * 8/1906 Westby ..... 108/153.1
1,097,697 A * 5/1914 Weston ..... 108/186
2,088,077 A * 7/1937 Wood ..... 312/140.3
2,533,831 A * 12/1950 Molla ..... 108/186
2,617,998 A * 11/1952 Reece ..... 5/3
2,937,765 A * 5/1960 Shank ..... 108/143
3,221,677 A * 12/1965 Kerr ..... 108/102
3,533,363 A * 10/1970 Reiss ..... 108/153.1
4,020,771 A * 5/1977 Hasenour ..... 108/86
4,286,525 A * 9/1981 Willmore ..... 108/93
4,665,838 A * 5/1987 Minshall ..... 108/186
4,718,354 A * 1/1988 Piretti ..... 108/68
5,809,901 A * 9/1998 Gutzmer ..... 108/27
5,947,037 A * 9/1999 Hornberger et al. ..... 108/115
6,425,558 B1 * 7/2002 Saunders ..... 248/166

FOREIGN PATENT DOCUMENTS

CH 630791 * 7/1982

* cited by examiner

*Primary Examiner*—Jose V. Chen
(74) *Attorney, Agent, or Firm*—Jeffrey D. Moy; Harry M. Weiss; Weiss, Moy & Harris, P.C.

(57) ABSTRACT

A piece of furniture having interchangeable components is will have a plurality of interchangeable leg members. Cross-bar members are removably coupled to the plurality of leg members. The cross-bar members are adjustable in length. Cross-bar covers are removably coupled to the cross-bar members. A table top is removably coupled to the cross-bar covers.

24 Claims, 3 Drawing Sheets

FURNITURE HAVING INTERCHANGEABLE PARTS AND METHOD THEREOF

BACKGROUND OF THE INVENTION

1. Field of the Invention

This invention relates to furniture, and more specifically, to a furniture system which will allow an individual to interchange parts so that the furniture will have a different look or style.

2. Description of the Prior Art

When decorating a home, apartment, office or the like, people tend to buy furniture which matches the decor of the room where the piece of furniture will be placed. People tend to spend hundreds to thousands of dollars in order to coordinate the furniture with the surrounding decor. However, as time goes by, many people like to change the appearance or the decor of their home or office. The changing of decor can be extremely expensive. This is especially so if the person wants to properly match the furniture to the decor.

Presently, there is no simple and easy way to change the look or appearance of a piece of furniture. In general, most pieces of furniture are individually made and constructed together piece by piece permanently. To change the look or appearance of the furniture would require one to take apart and reconstruct the piece of furniture. This would be very time consuming and expensive. Unfortunately, most people do not have the time, money, or skill to redecorate their home or office too often.

Therefore, a need existed to provide an improved piece of furniture and method therefor. The improve piece of furniture and method of constructing the same would allow one to easily change the appearance of the piece of furniture without the problems associated with prior art furniture pieces.

SUMMARY OF THE INVENTION

In accordance with one embodiment of the present invention, it is an object of the present invention to provide an improved piece of furniture and method therefor.

It is another object of the present invention to provide an improve piece of furniture and method of constructing the same which would allow one to easily change the appearance of the piece of furniture without the problems associated with prior art furniture pieces.

BRIEF DESCRIPTION OF THE EMBODIMENTS

In accordance with one embodiment of the present invention, a piece of furniture having interchangeable components is disclosed. The furniture will have a plurality of leg members. Cross-bar members are removably coupled to the plurality of leg members. The cross-bar members are adjustable in length. Cross-bar covers are removably coupled to the cross-bar members. A table top is removably coupled to the cross-bar covers.

In accordance with another embodiment of the present invention, a method of constructing a piece of furniture having interchangeable components is disclosed. The method comprises: providing a plurality of interchangeable leg members; removably coupling cross-bar members to the plurality of leg members wherein the cross-bar members are adjustable in length; removably coupling cross-bar covers to the cross-bar members; and removably coupling a table top to the cross-bar covers.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENTS

Figure 1:
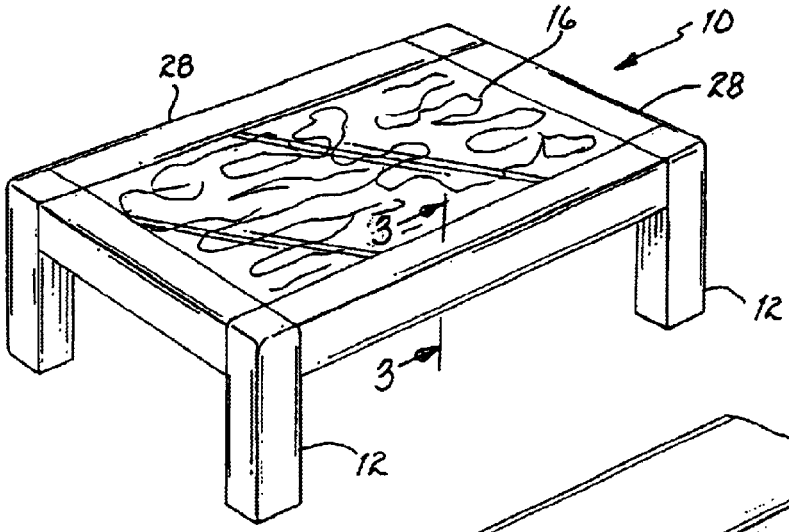
FIG. 1 is an elevated perspective view of one embodiment of the present invention.
Figure 2:
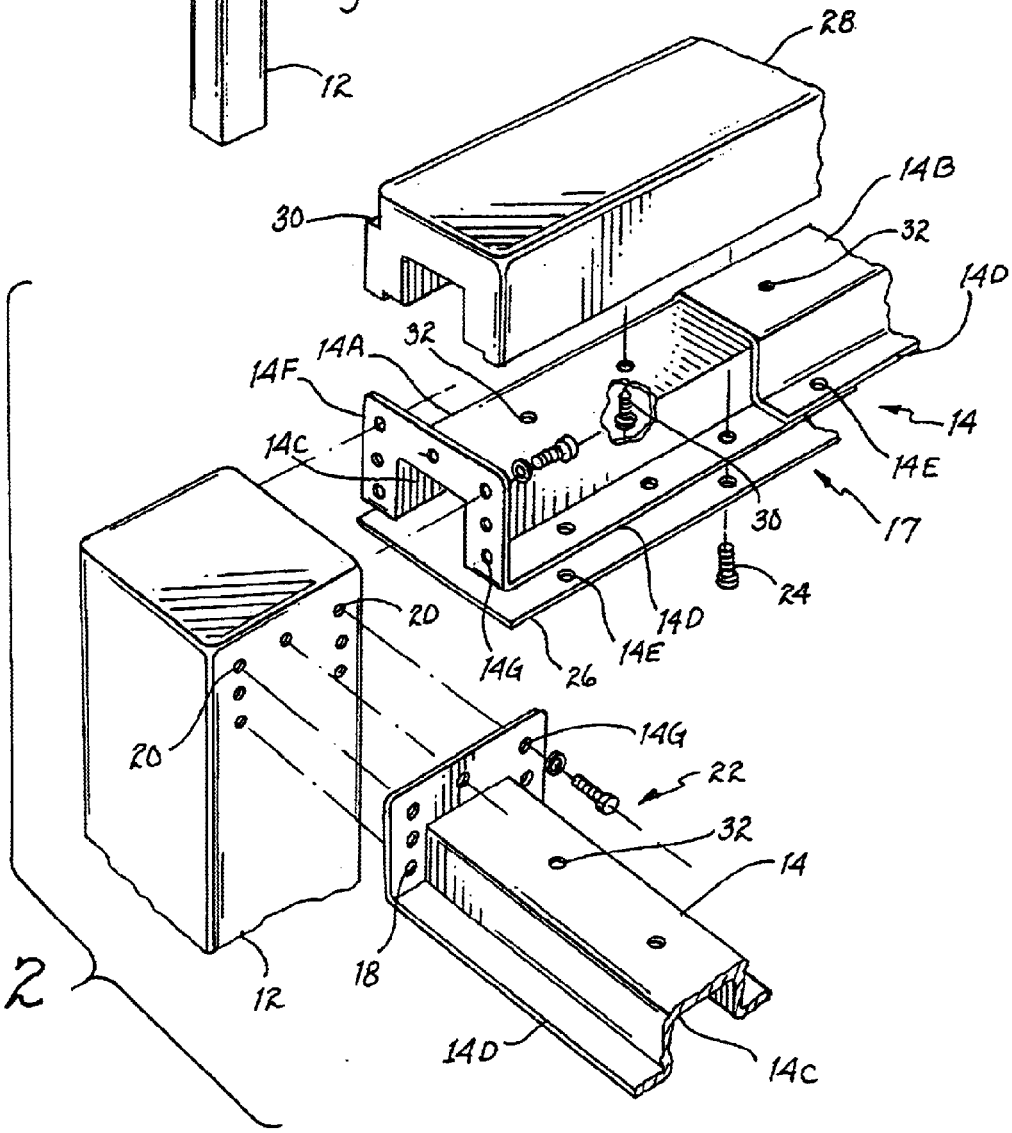
FIG. 2 is an exploded view of the leg assembly of the embodiment depicted in FIG. 1.
Figure 3:
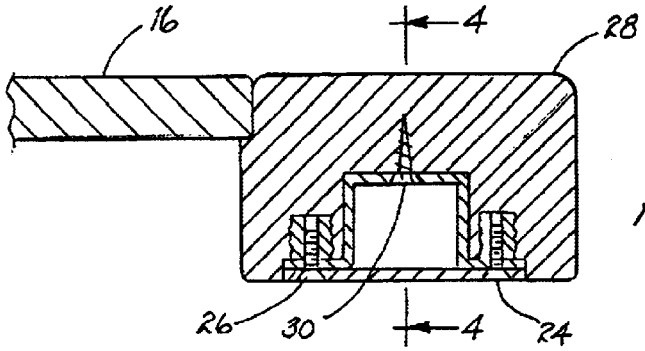
FIG. 3 is a cross-sectional view.
Figure 4:
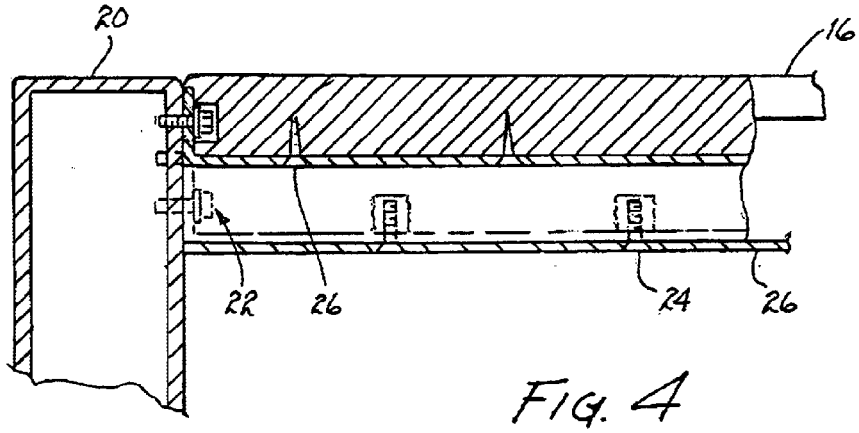
FIG. 4 is a cross-sectional side view taken along lines 4—4 of FIG. 3.

Referring to FIGS. 1–4, one embodiment of the table 10 of the present invention is shown. The table 10 is unique in that the table 10 will have interchangeable components which will allow one to easily change the appearance of the table 10 to match different decors. Although the description and Figures will be geared towards a coffee table 10, the invention may be drawn to other types of tables (i.e., end tables, dinning tables, etc.) as well as to other types of furniture.

The table 10 will have a plurality of leg members 12. The leg members 12 are used to raise and support the table 10. The leg members 12 are interchangeable. Thus, different styles and types of leg members 12 may be used. The leg members 12 may come in different sizes, shapes and materials. For example, the leg members 12 may be rectangular or circular column members or the like. The leg members 12 may be made from wood, metal, or other materials. The leg members 12 may have certain finishes such as a metallic satin or brushed look. It should be noted that the above are given as examples and should not be seen as to limit the scope of the present invention. What is one unique feature of the present invention is that the table 10 will have a plurality of interchangeable leg members 12 so that different styles and types of leg members 12 may be used on the table 10.

A pair of cross-members 14 will be removably coupled to each leg member 12. The cross-members 14 are designed to be interchangeable so that the cross-members 14 may be coupled to any style or type of leg member 12. The cross-members 14 are used to hold and support a table top section 16. The cross-members 14 are telescopic in nature. Thus, one can adjust the length of the cross-member 14. This will allow an individual to alter the length/width of the table 10. Each cross-member 14 will have a locking mechanism 17. The locking mechanism 17 is used to hold and lock the cross-member 14 at a desired length.

The cross-members 14 in FIGS. 1–4 will be comprised of a first section 14A and a second section 14B. The first section 14A and the second section 14B are both similar in shape and appearance. Both sections 14A and 14B have a rectangular channeling 14C. The channeling 14C of the second section 14B will slide over the top of the channeling 14C of the first section 14A. This will allow the cross-members 14 to be adjustable in length. Along the sides of the channeling 14C will be a flat planer surface 14D. The flat planner surface 14D will have a plurality of openings 14E. The openings 14E will have two main functions. First, the openings 14E are used to adjust and secure the first section 14A to the second section 14B. When properly aligned, the openings 14E in the first section 14A will be aligned with openings 14E in the second section 14B. A locking device 24 is then used to secure the first section 14A to the second section 14B.

The openings 14E are further used to secure a cover 26 over the channeling 14C. The cover 26 is used to hide the channeling 14C. The cover 26 will have a plurality of openings 26A. The openings 26A will be formed on both sides of the cover 26. When properly aligned, the openings 26A will be in axial alignment with a corresponding openings 14E. The locking device 24 used to secure the first section 14A to the second section 14B may further be used to secure the cover 26 to the cross-members 14. The locking device 24 is generally a screw, removable rivet, and the like. It should be noted that the above are given as examples and should not be seen as to limit the scope of the present invention.

In the embodiment depicted in FIGS. 1–4, each end of the cross-member 14 will have a plate 14F. The plate 14F will have a plurality of holes 14G. When the cross-member 14 is properly aligned with a leg member 12, the holes 14G located in the cross-member 14 will be aligned with a plurality of corresponding holes 20 located in the leg member 12. A plurality of coupling devices 22 are used to removably couple the cross members 14 to the leg members 12. The coupling devices 22 will generally be a screw and nut combination or the like. However, this should not be seen as to limit the scope of the present invention, any type of removable coupling device 22 may be used.

A cross-member cover 28 is used to cover the top section of the cross-member 14. The cross-member cover 28 is similar in shape to the cross-member 14. One main difference is that the cross-member cover 28 will have an "L" shaped edge 30 located on one side of the cross-member cover 28. The "L" shape edge 30 is used so that the cross-member cover 28 can support a table top 16. The cross-member cover 28 will be removably coupled to the cross-member 14. A removable coupling device 30 is used to couple the cross-member cover 28 to the cross member 14. In the embodiment shown in the Figures, the cross-member 14 will have a plurality of openings 32 drill through a top section of the cross-member 14. The removable coupling device 30 will be inserted through the opening 32 and into the cross-member cover 28 thereby securing the cross-member cover 28 to the cross-member 14. The removable coupling device 30 will generally be a screw, removable rivet and the like. However, the above examples should not be seen as to limit the scope of the present invention, any type of removable coupling device 30 may be used.

The cross-member cover 28 may be made in a plurality of shapes and materials. For example, the cross-member cover 28 may be flat and rectangular as shown in FIGS. 1–4. Alternatively, the cross-member cover 28 may be more rounded like that shown in FIGS. 6 and 7. The cross-member cover 28 may be made out of a solid hard material like wood, metal, imitation rock (i.e., granite, marble, and the like). Alternatively, the cross-member cover 28 may be padded and upholstered. Thus, one would be able to comfortably rest ones' feet, arms, or the like on the table 10. It should be noted that the above are given as examples and should not be seen as to limit the scope of the present invention.

As stated above, a table top section 16 is positioned on the "L" shaped edge 30 located on one side of the cross-member cover 28. The table top section 16 will also come in a variety of shapes and sizes. The table top section 16 is generally sized to properly fit within the frame formed by the cross-member cover 28. The table top can be made out of wood, metal, glass or other clear materials, and the like. Once again, it should be noted that the above are given as examples and should not be seen as to limit the scope of the present invention.

Figure 6:
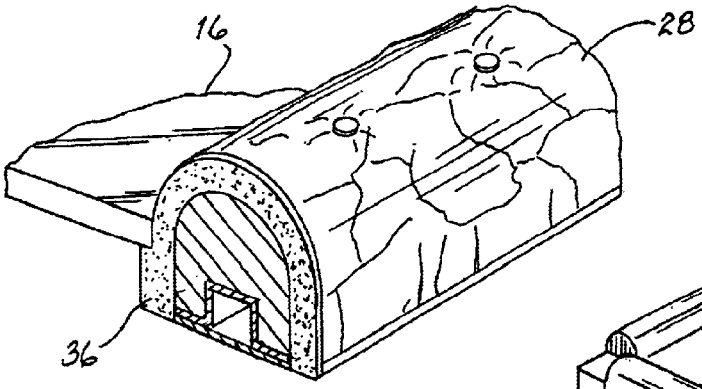
FIG. 6 is a close-up view of the cross-member used in the embodiment depicted in FIG. 5.
Figure 5:
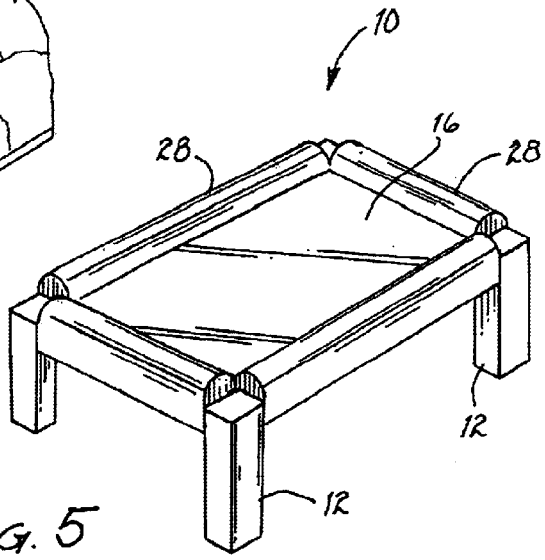
FIG. 5 is an elevated perspective view of another embodiment of the present invention.

Referring to FIGS. 5 and 6, another embodiment of the table 10 is shown. In this embodiment, the table 10 is similar to that shown in FIGS. 1–4. The main difference is that the cross-member cover 28 is rounded and has padding 36.

Figure 7:
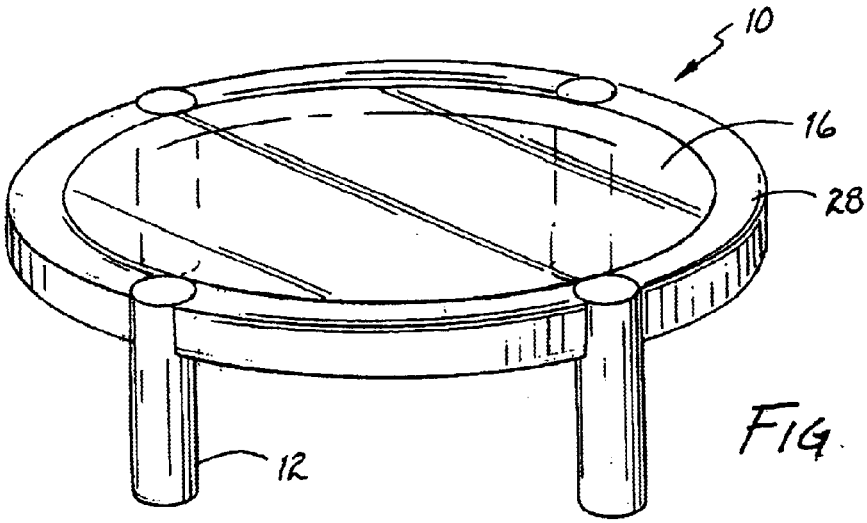
FIG. 7 is an elevated perspective view of another embodiment of the present invention.
Figure 8:
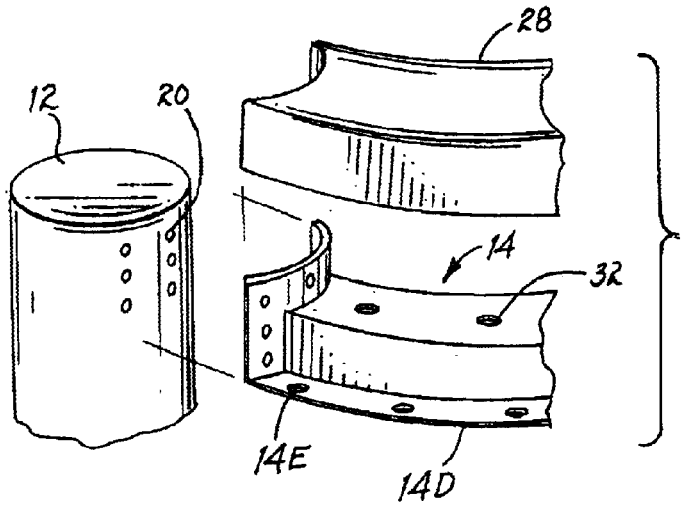
FIG. 8 is an exploded view of the leg assembly of the embodiment depicted in FIG. 7.

Referring to FIGS. 7 and 8, another embodiment of the table 10 is shown. In this embodiment, the table 10 is similar to that shown in FIGS. 1–4 and FIGS. 5–6. The main difference is that the table 10 is rounded. Thus, the cross-member 14, the cross-member cover 28, the table top 16 are all rounded. In this embodiment, the legs 12 are also rounded.

The table 10 is unique in that the components of the table 10 are interchangeable. Thus, one can change the look and appearance of the table 10. Furthermore, one can change the function of the table 10. For example, the table 10 may be transformed from an end table to a coffee table to a dinning table all by changing the length/width of the cross-members 14 and the height of the leg members 12.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A piece of furniture having interchangeable components comprising:

a plurality of leg members;

cross-bar members removably coupled to the plurality of leg members wherein the cross-bar members are adjustable in length, wherein the cross-bar members comprises:

a first member wherein the first member has a channeling running an entire length of the first member; and a second member wherein the second member has a channeling running an entire length of the second member and wherein the channeling of the second member will slide over the channeling of the first section;

a plurality of cross-bar member covers of different lengths, each of the plurality of cross-bar member covers formed to fit and be removably coupled to a cross-bar of a determined length; and a plurality of table tops of different sizes removably coupled to the cross-bar member covers.

2. A piece of furniture having interchangeable components in accordance with claim 1 wherein the plurality of leg members are interchangeable so a first set of leg members are interchangeable with a second set of leg members wherein the second set of leg members are of a different appearance from the first set of leg members.

3. A piece of furniture having interchangeable components in accordance with claim 1 wherein the plurality of leg members are metallic in appearance.

4. A piece of furniture having interchangeable components in accordance with claim 1 wherein the plurality of leg members are wooden in appearance.

5. A piece of furniture having interchangeable components in accordance with claim 1 wherein the cross-bar members are linear.

6. A piece of furniture having interchangeable components in accordance with claim 1 wherein the cross-bar members are arched.

7. A piece of furniture having interchangeable components in accordance with claim 1 wherein the cross-bar members further comprises:

a flat planer section formed on each side of the channeling; and a plate section coupled to an end of the first member and the second member for removably coupling the cross-bar member to the leg members.

8. A piece of furniture having interchangeable components in accordance with claim 7 further comprising a cover member removably coupled to the flat planer section of the cross-bar member to cover the channeling of the cross-bar member.

9. A piece of furniture having interchangeable components in accordance with claim 1 wherein the plurality of cross-bar covers comprises a plurality of different sets of cross-bar covers, each of the plurality of sets are of a different appearance.

10. A piece of furniture having interchangeable components in accordance with claim 1 wherein the plurality of cross-bar covers are padded.

11. A piece of furniture having interchangeable components in accordance with claim 1 wherein the plurality of cross-bar member covers have a wood finish.

12. A piece of furniture having interchangeable components in accordance with claim 1 wherein the plurality of cross-bar member covers have a painted wood finish.

13. A piece of furniture having interchangeable components in accordance with claim 1 wherein the plurality of cross-bar member covers have a metallic finish.

14. A piece of furniture having interchangeable components in accordance with claim 1 wherein the plurality of cross-bar member covers have an upholstered cover.

15. A piece of furniture having interchangeable components comprising:

a plurality of leg members wherein the plurality of leg members are interchangeable so a first set of leg members are interchangeable with a second set of leg members wherein the second set of leg members are of a different appearance from the first set of leg members;

cross-bar members removably coupled to the plurality of leg members wherein the cross-bar members are adjustable in length wherein the cross-bar members comprises:

a first member wherein the first member has a channeling running an entire length of the first member; and a second member wherein the second member has a channeling running an entire length of the second member and wherein the channeling of the second member will slide over the channeling of the first section;

a flat planer section formed on each side of the channeling; and a plate section coupled to an end of the first member and the second member for removably coupling the cross-bar member to the leg members;

a cover member removably coupled to the flat planer section of the cross-bar member to cover the channeling of the cross-bar member;

a plurality of cross-bar member covers of different lengths, each of the plurality of cross-bar member covers formed to fit and be removably coupled to a cross-bar of a determined length and a plurality of table tops of different sizes removably coupled to the cross-bar member covers.

16. A piece of furniture having interchangeable components in accordance with claim 15 wherein the plurality of leg members are metallic in appearance.

17. A piece of furniture having interchangeable components in accordance with claim 16 wherein the plurality of cross-bar member covers have an upholstered cover.

18. A piece of furniture having interchangeable components in accordance with claim 15 wherein the plurality of leg members are wooden in appearance.

19. A piece of furniture having interchangeable components in accordance with claim 15 wherein the cross-bar members are linear.

20. A piece of furniture having interchangeable components in accordance with claim 15 wherein the cross-bar members are arched.

21. A piece of furniture having interchangeable components in accordance with claim 15 wherein the plurality of cross-bar covers are padded.

22. A piece of furniture having interchangeable components in accordance with claim 15 wherein the plurality of cross-bar member covers have a wood finish.

23. A piece of furniture having interchangeable components in accordance with claim 15 wherein the plurality of cross-bar member covers have a wood finish.

24. A piece of furniture having interchangeable components in accordance with claim 15 wherein the plurality of cross-bar member covers have a metallic finish.

* * * * *